US008336831B2

(12) United States Patent
Naquin

(10) Patent No.: US 8,336,831 B2
(45) Date of Patent: Dec. 25, 2012

(54) SWITCH OR RAIL BOX WITH SEALING SYSTEM FOR RAILWAY RAILS AND METHODS FOR SEALING THE BOX

(75) Inventor: Rene' Naquin, Orange, TX (US)

(73) Assignee: R&R Solutions, LP, Rancho Cucamonga, CA (US)

( * ) Notice: Subject to any disclaimer, the term of this patent is extended or adjusted under 35 U.S.C. 154(b) by 318 days.

(21) Appl. No.: 12/925,061

(22) Filed: Oct. 12, 2010

(65) Prior Publication Data

US 2011/0084175 A1 Apr. 14, 2011

Related U.S. Application Data

(60) Provisional application No. 61/278,833, filed on Oct. 13, 2009.

(51) Int. Cl.
*E01B 7/00* (2006.01)

(52) U.S. Cl. ..... 246/415 R; 246/375; 246/454; 238/2

(58) Field of Classification Search ..... 246/375, 246/382, 415 R, 419, 427, 428, 435 A, 453, 246/435 R, 436, 448, 454, 449, 450, 460, 246/461, 465, 468, 471, 472; 238/1, 2, 8, 238/14.05, 152, 154, 161.5, 162, 127; 104/139, 104/140, 141, 142, 145
See application file for complete search history.

(56) References Cited

U.S. PATENT DOCUMENTS

| | | | | | |
|---|---|---|---|---|---|
| 788,776 | A | * | 5/1905 | Jordan | 238/161 |
| 833,020 | A | * | 10/1906 | Bossert | 238/154 |
| 1,015,541 | A | * | 1/1912 | Christian | 246/460 |
| 1,378,277 | A | * | 5/1921 | Rihn et al. | 246/375 |
| 1,473,205 | A | * | 11/1923 | Bragg | 238/49 |
| 1,564,340 | A | * | 12/1925 | Garlick | 246/442 |
| 2,670,136 | A | * | 2/1954 | Moses | 238/155 |
| 4,067,257 | A | * | 1/1978 | Pentith | 104/140 |
| 4,876,784 | A | * | 10/1989 | Bussolino | 29/402.06 |
| 4,911,360 | A | * | 3/1990 | Spurr | 238/5 |
| 5,186,421 | A | | 2/1993 | Caccomo | |
| D345,119 | S | * | 3/1994 | Cox | D12/51 |
| 5,609,294 | A | * | 3/1997 | Lucas, Jr. | 238/9 |
| 5,797,565 | A | | 8/1998 | Tuningley et al. | |
| 5,988,519 | A | * | 11/1999 | Jordie | 238/15 |
| 6,511,024 | B1 | | 1/2003 | Bonfigli | |
| 7,185,860 | B2 | | 3/2007 | O'Brien et al. | |
| 2001/0028001 | A1 | * | 10/2001 | Vennell | 238/1 |
| 2005/0116118 | A1 | * | 6/2005 | O'Brien et al. | 246/415 R |

FOREIGN PATENT DOCUMENTS

| | | |
|---|---|---|
| WO | WO 03/076721 | 9/2003 |

* cited by examiner

*Primary Examiner* — Mark Le

(74) *Attorney, Agent, or Firm* — Hudak, Shunk & Farine Co. LPA

(57) ABSTRACT

A switch or rail box for railway rails that include a system for sealing a portion of a location where the rail enters or exits the box. The sealing system includes a pair of seal plates that can be connected to an inner surface and an outer surface of the switch box, wherein the sealing plates each include a groove that conforms to and accepts a portion of a rail and in some embodiments, a rail jacket. The channel formed between the adjacent seal plates is filled with an insulating material that extends around a lower portion of the rail, thereby aiding in stray current control. Methods for sealing the switch box utilizing the sealing system are disclosed.

13 Claims, 7 Drawing Sheets

SWITCH OR RAIL BOX WITH SEALING SYSTEM FOR RAILWAY RAILS AND METHODS FOR SEALING THE BOX

CROSS-REFERENCE

This Application claims the benefit of priority under 35 U.S.C. §119 of U.S. Provisional Application Ser. No. 61/278,833, filed on Oct. 13, 2009, herein fully incorporated by reference.

FIELD OF THE INVENTION

The present invention relates to a switch or rail box for railway rails that includes a system for sealing a portion of a location where the rail enters or exits the box. The sealing system includes a pair of seal plates that can be connected to an inner surface and an outer surface of the switch box, wherein the sealing plates each include a groove that conforms to and accepts a portion of a rail and in some embodiments, a rail jacket. The channel formed between the adjacent seal plates is filled with an insulating material that extends around a lower portion of the rail, thereby aiding in stray current control. Methods for sealing the switch box utilizing the sealing system are disclosed.

BACKGROUND OF THE INVENTION

Switch boxes or rail boxes are used in many different applications of railway layouts. The boxes are used to house various components including, but not limited to, switches, frogs, retaining rails, and other special tracks. Some boxes have a plurality of openings that allow one or more rails to pass through or be located in a portion of the box. Some boxes have drains located in a bottom of the box to allow water to exit the box.

U.S. Pat. No. 5,186,421 relates to a rail finder for railroad bridges reportedly compactly and uniquely designed to minimize false signals and decrease replacement and maintenance costs. A weighted lever mounted on switch-box rotatable shaft that is perpendicularly disposed with respect to the rail has an offset portion directly engagable by a horizontal plate mounted on the inner surface of a rail on a bridge. The plate holds the lever in a horizontal position in the down position of the bridge. When the bridge raises, the weighted lever follows the plate and rotates the switch box shaft to where cams move switchable elements from a set of contacts. The contacts of the set are in circuit with green lights permitting train passage when the cams are out of contact with the switchable elements. The compact arrangements reportedly allow a pair of rail finders to be mounted side-by-side within the gauge and thus out of the path of loose or low third-rail shoes of electrically powered trains.

U.S. Pat. No. 5,797,565 relates to a railway crossing, sometimes referred to as a diamond crossing, which has four substantially identical crossing beams which have cutouts made for a wide range of crossing angles. At least two separate base plates are cut to fit the required crossing angle and positioned beneath the crossing beams. Each crossing beam has a flangeway groove extending along at least a portion of the beam length and each beam has integral rail shaped ends for connection to a standard rail section. The crossing beams have top cutouts and bottom cutouts that intersect and are set for a predetermined crossing angle. Boltless locator pins prevent horizontal movement of the top and bottom beams on the plates, and elastic fasteners hold the top and bottom beams to the plates to restrict vertical movement between the top and bottom beams and the plates.

U.S. Pat. No. 6,511,024 relates to a switch box for railway, tramway, points or similar, of the so-called English type, i.e., having four or more blades comprising a drive unit of the transfer motion of the blades of the switch, and at least one group of linear transmission of the drive motion to the blades, movable means to lock the blades in their respective position of closure. According to the invention, the said groups are housed in a box which reportedly has substantially the dimensions and the shape of a sleeper and that is reportedly fitted in the track in place of and with the function of a sleeper.

U.S. Pat. No. 7,185,860 relates to a modular tongue switch assembly comprising a tongue pivotally connected to a slide surface held down by a pivot retainer. The slide surface consists of slide plate sections removably attached to corresponding bed plate sections, which are in turn welded onto a base plate. Floating brace blocks hold a non-integral stock rail in place on the base plate. When the tongue moves, a horizontal lever arm actuates an inner box assembly housed within an outer box and containing the conductor rail, reportedly allowing the passing train to maintain contact with the conductor rail, if necessary. A rodding and lever arrangement is used.

International Publication No. WO 03/076721 relates to a switch box comprising switch bed plates fixed on a base, two pairs of switches connected with the rails connecting the main and the side railways, a movable frog, rail latches and drives. Characterized in that the frog has a U-like configuration, guide grooves are made in the switch bed-plates. In the grooves, the rail latches and cover plates of the rail are mounted being set on a switch base and connected with one another by means of traction. The switches are connected stiffly or are made unit-cast and the shape of each corresponds to the curvature of the railway, whereas the switches and the frog have obtuse ends and are capable of turning on the vertical axes fixed on the plate between the rails.

In view of the above, a need still exists in the art for a system that can be utilized to seal a switch or earth box where the rail enters or exits the box in order to reduce or eliminate the amount of stray electric current that leaves the box. Furthermore, at the exit and entry points to a switch or earth box, a need exists to seal around rubber lined rail, polyurethane coated rail, and rail insulated with a thermoplastic elastomer or rubber boot.

SUMMARY OF THE INVENTION

It is an object of the present invention to provide a sealing system for sealing a portion of the switch or rail box in order to prevent entrance of water or debris into the box where the sealing system is connected.

A further object of the present invention is to provide a sealing system comprising a pair of seal plates, wherein one of the seal plates is adapted to be connected to an inner surface of a side portion of a switch box and a second seal plate is adapted to be connected it to an outer surface of the side of the switch box, the seal plates each having a groove that accepts a portion of the rail passing through a portion of the box.

Still another object of the present invention is to provide a sealing system comprising a pair of plates connected to a switch box and forming a channel in which an insulating material is located, the insulating material in contact with the seal plates and also a portion of the rail thereby aiding in stray current and vibration control.

A further object of the present invention is to provide a seal plate having a groove conforming substantially to a cross-sectional portion of a rail, wherein the rail optionally includes a rail jacket.

Another object of the present invention is to provide a sealing system comprising a seal plate and insulating material.

Additional objects of the invention are to modify switch or earth box openings by creating extended flanged openings that create the sides and bottom of the mold.

In one aspect of the present invention, a rail or switch box system for railway rails is disclosed, comprising a rail box having a side wall including an aperture adapted to have a portion of a rail extend therethrough, a first seal plate connected to an inner surface of the rail box side wall about a portion of the aperture, a second seal plate connected to an outer surface of the rail box side wall about a portion, of the aperture, one or more rails having a portion extending through a groove in the first and second plates and the aperture in the box, and an insulating material located between the first plate and the second plate and in contact with a portion of the rail.

In a further aspect of the present invention, a sealing system is disclosed, comprising a plurality of seal plates adapted to be connected to a portion of a rail box, each plate having a groove adapted to accept a portion of a rail, and an insulating material, wherein the seal plates are separated by a channel therebetween and the insulating material is in contact with each of the plates.

In still another aspect of the present invention, a method for sealing a portion of a rail box is disclosed, comprising the steps of obtaining a box having at least two apertures in a side wall of the box, orienting at least one rail such that the rail extends through the aperture in the side wall of the box, attaching a first seal plate to an outer surface of the side wall of the box and a second seal plate to an inner surface of the side wall of the box around the rail, the seal plates thereby covering a portion of an aperture in the side of the box and forming a channel between the seal plates, and adding an insulating material to the channel formed between the first plate and second plate, with the insulating material contacting each plate and a portion of one or more rails.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
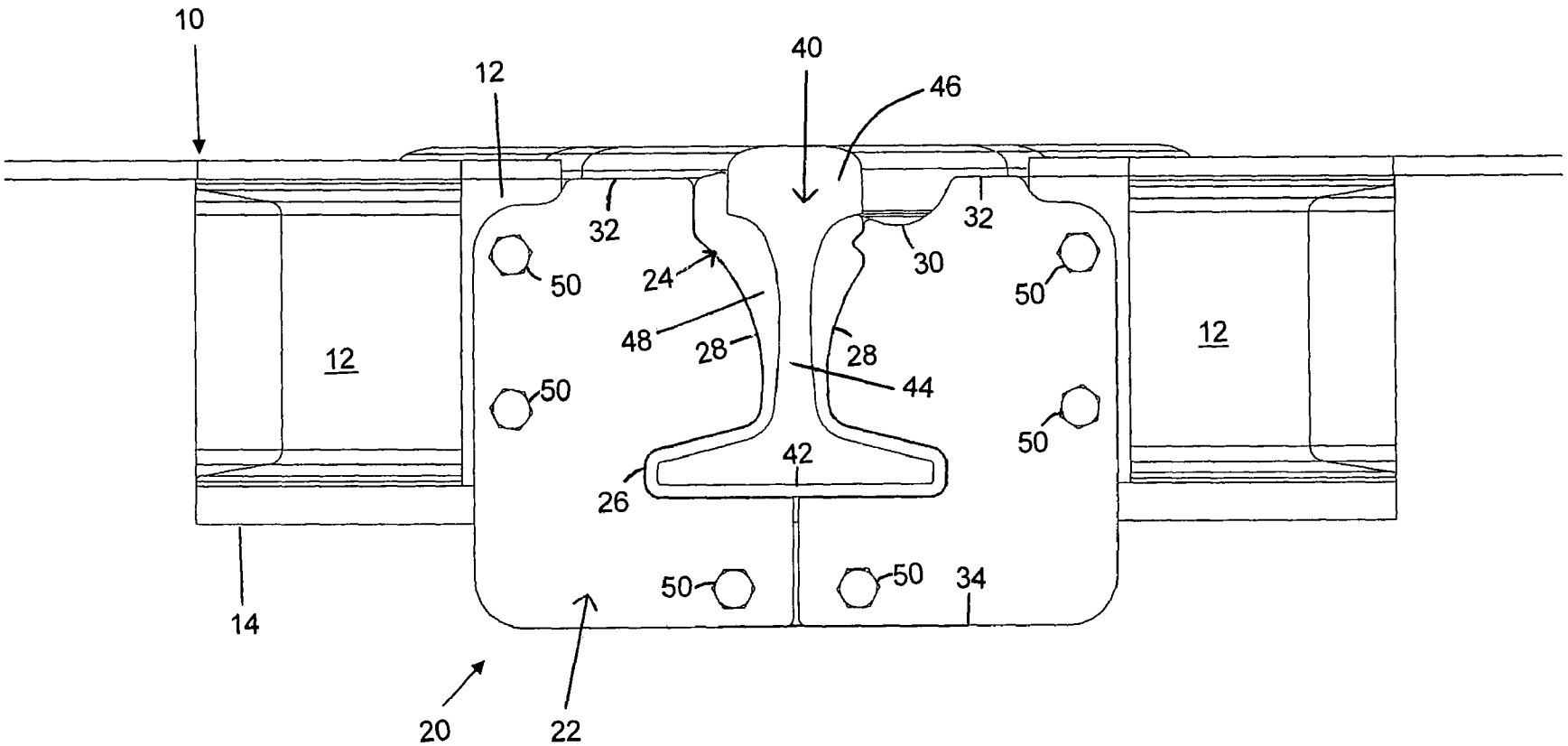
FIG. 1 is a side elevational view of one embodiment of a portion of the rail box system of the present invention particularly illustrating a seal plate connected to a portion of a switch or rail box, the sealing plate including a groove through which a portion of a rail extends, wherein the rail includes a rail jacket along a portion of the surface thereof.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, FIG. 1 partially illustrates one embodiment of a sealing system 20 that is adapted to be used in conjunction with a box 10 such as a switch box or rail box that is adapted to be used in conjunction with a rail system, i.e., railway, tramway, etc. The box 10, as known in the art, can be incorporated under the trackwork or otherwise assimilated into the environment in which the box is used. In various embodiments, flange openings with bolt holes or apertures can be welded onto a box flange opening and the box, if not previously coated, can be coated with a non-conductive material.

Figure 2:
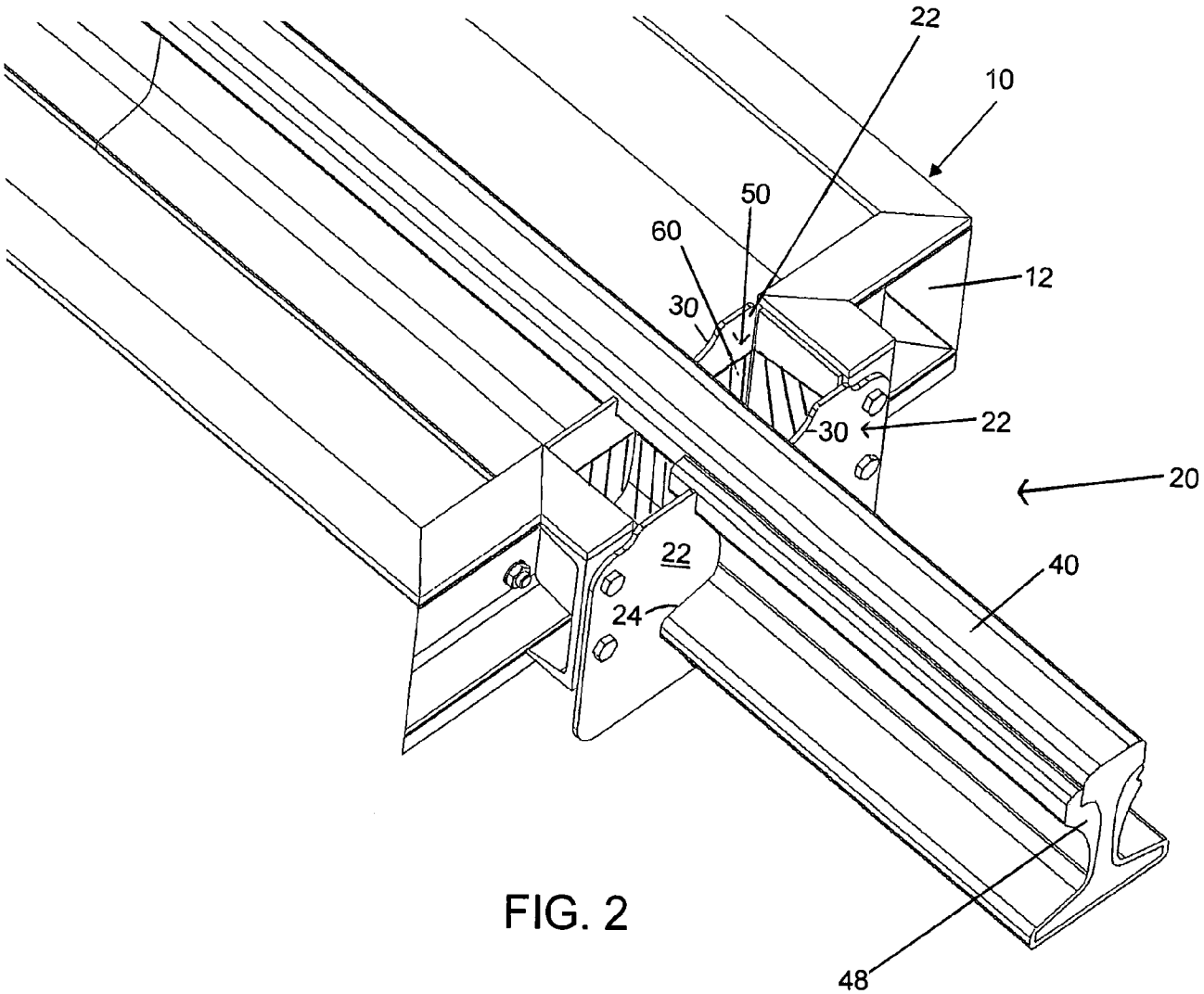
FIG. 2 is a front right perspective view of a portion of the sealing system of the present invention installed on a switch or rail box, the view including a first sealing plate connected to an outer surface of the box and a second sealing plate connected to an inner surface of the rail box, with a rail extending through a groove in each of the sealing plates, and an insulating material is located in a channel formed between sealing plates and in contact with a portion of the rail.
Figure 3:
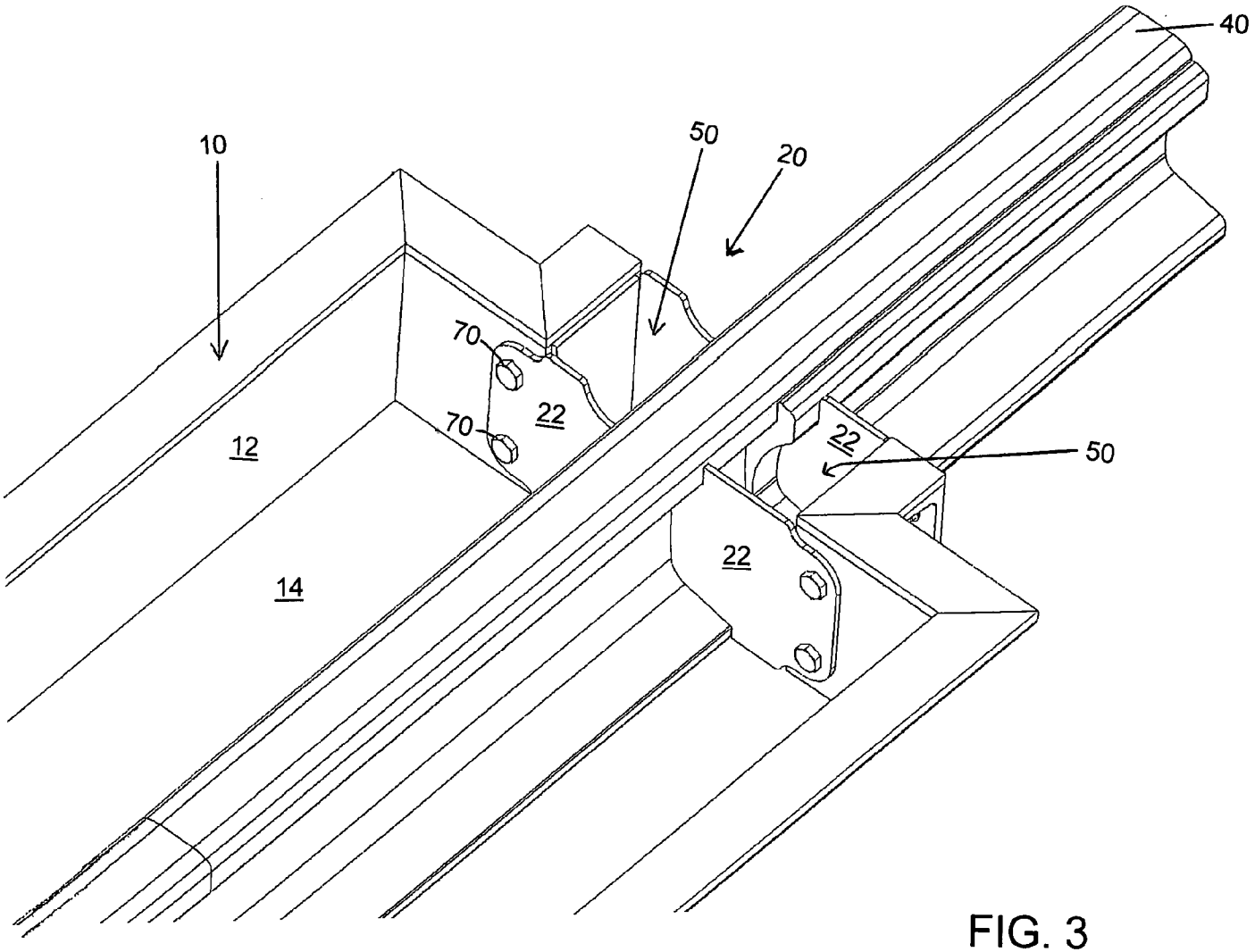
FIG. 3 is a forward-looking right side perspective view of one embodiment of the sealing system of the present invention installed on a switch or rail box, with a rail extending through a groove in each of the sealing plates present.

The box 10, to which the sealing system is connected, generally has three or more, preferably four or more, sides 12 and a bottom 14, see also FIGS. 2 and 3. As the box 10 is adapted to house a portion of one or more rails 40, the box 10 may have a top (not shown) in one or more pieces that cover areas adjacent the rail. In some embodiments, the bottom 14 includes a drain for removing any water and/or debris that accumulates in the box 10. Boxes 10 are commercially available from various manufacturers or can be fabricated on-site to fit a particular construction. The boxes can be sized and formed to accept any special track configuration.

Each seal plate 22 of sealing system 20 is formed from one or more pieces of material. Two abutted pieces are shown in FIG. 1. The seal plate 22 illustrated in FIG. 1 comprises two pieces. Desirably, the seal plate 22 has a non-conductive outer surface to aid in stray current control. The entire seal plate can be fabricated out of a non-conductive material, such as a polymer. In other embodiments, the seal plate comprises a base layer such as of a strong, durable material for example, a metal such as steel, and the base layer is further covered by an additional layer or layers, for example a coating, such as a non-conductive polymer, e.g., a polyurethane, epoxy, polyurea, rubber lining, or a rubber/epoxy mixture coating. Non-conductive plates can be polycarbonate, HDPE, or other type of polymer.

As indicated hereinabove, the seal plate 22 includes a groove 24 that surrounds the rail 40, such as shown in the drawings. The groove 24 preferably surrounds a lower portion of the rail 40. The rail can also include a rail cover or rail jacket 48, as known in the art, see for example U.S. Pat. No. 7,556,209, herein fully incorporated by reference. The rail 40 can have generally any shape as known in the art. In one embodiment, as illustrated in FIG. 1, the rail 40 has a generally I-shaped cross-sectional configuration and includes a bottom flange 42 with a lower surface, opposite sides and sloped upper surfaces that merge into a web portion 44. The rail 40 includes a top or upper flange 46, preferably having a convex top surface and preferably a sloped underface that connects to the upper end of the vertical web portion 44. In a preferred embodiment, the bottom flange 42 has a greater width than the top flange in order to provide stability to the rail 40.

Therefore, the groove 24 has, in one embodiment, a base 26 located adjacent the bottom flange 42, the base 26 extending around the sloped upper surfaces of the bottom flange 42 and extending into an intermediate section 28 located adjacent the web portion 44 of rail 40. In one embodiment as illustrated, the intermediate section 28 extends and terminates below the upper flange 46 of the rail 40 at a cutout 30 that allows the wheel flange of a vehicle, e.g. locomotive, rail car, passenger car, etc., traveling on the rail to pass the seal plate 22 without contacting the same. The cutout terminates at an upper end 32 of the seal plate. The cutout has a rounded shape in one embodiment. The upper end 32 of the seal plate 22 generally ends at or below a maximum height of the box 10. The seal plate 22 also includes a lower end 34.

A seal plate 22 can be connected to the box 10 in generally any manner that provides for a suitable connection therebetween. For example, the seal plate 22 can be adhered from the side 12 of box 10 utilizing an adhesive in order to make the connection. Adhesives are used in conjunction with fasteners 70 in order to make the connection in some embodiments. Fasteners 70 are illustrated in FIG. 1. Welding can be used in some embodiments.

In further embodiments, the seal plate 22 also includes one or more apertures. Fastener 70, such as bolts can be inserted through the apertures thereby fastening the seal plates to the box in some embodiments.

Figure 4:
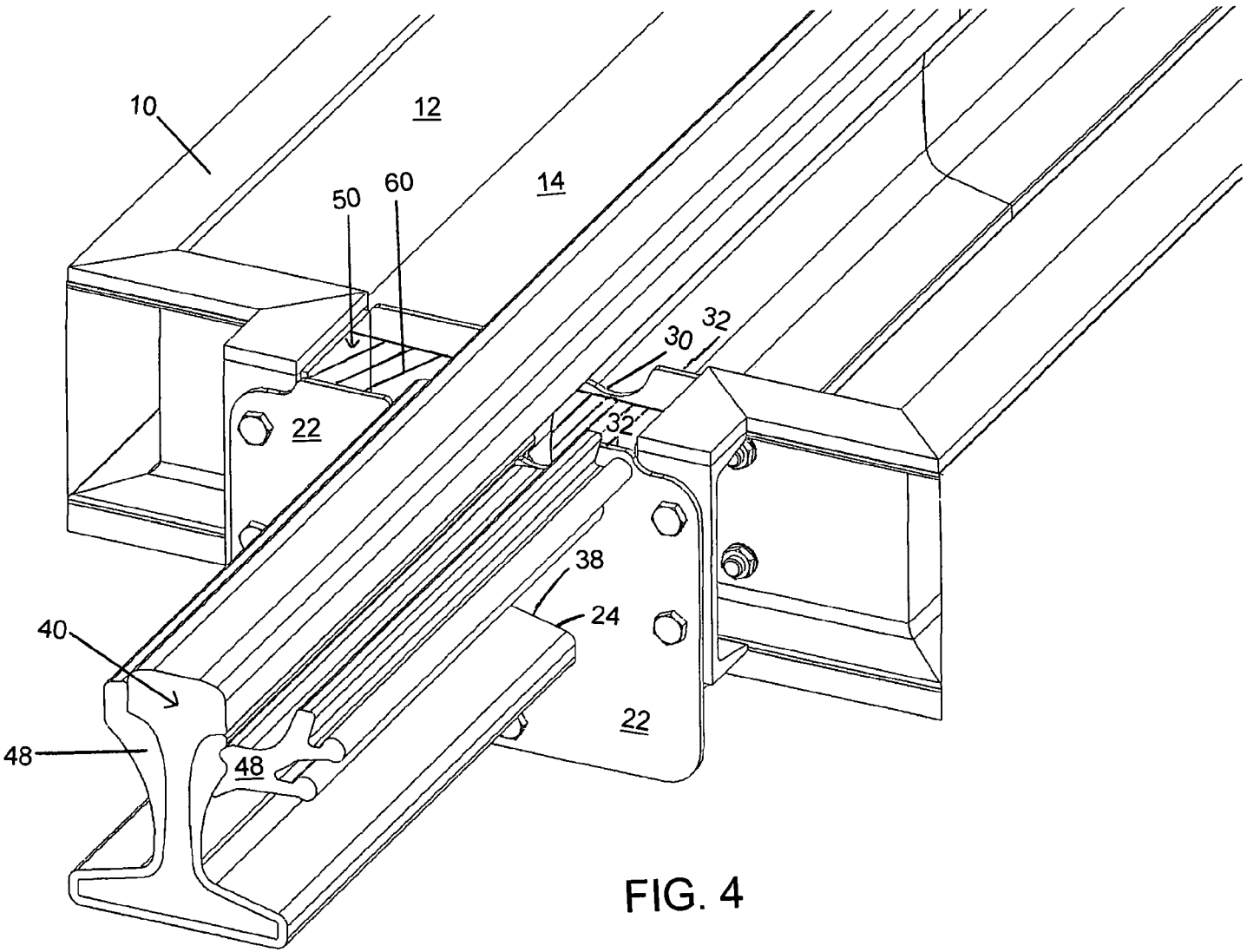
FIG. 4 is a front left perspective view further embodiment of a sealing system of the present invention installed on a switch or rail box wherein a portion of a rail extends through grooves in each of the sealing plates present and an insulating material is present in a portion of a channel between the sealing plates.

As illustrated in FIG. 4, the seal plate 22 upper end 32 can also have a projection 38 that accommodates a portion of a rail jacket 48.

As illustrated in FIGS. 2, 3 and 4, a channel 50 is formed by connection of two seal plates 22 to side 12 of box 10. As illustrated, one seal plate 22 is connected to an inner surface of side 12 and a second seal plate 22 is connected to an outer surface of side 12. Therefore, the channel 50 is bounded on one side by seal plate 22, and on the opposite side by seal plate 22, and on a bottom 14 of box 10. The width of the channel between seal plates 22 can vary depending upon the width and thickness of side 12 of box 10. In some embodiments, the width varies from about 2 to about 6 inches.

After channel 50 is formed, an insulating material 60 is added to channel 50, such as by pouring, spraying, etc., pouring is preferred. Insulating material 60 is generally a polymer, but can be another composition if desired. In one embodiment, the insulating material 60 is polyurethane. In other embodiments, the insulating material is an asphalt/polyurethane mixture, epoxy, rubber/epoxy or a rubber/polyurethane mixture. The channel 50 is filled to a sufficient depth with insulating material 60 such that insulating material 60 does not interfere with the operation of the rail 40. Stated differently, the insulating material is present in the channel 50 from the bottom of the box 10 to a location at or below the bottom edge of cutout 30. FIGS. 2 and 4 illustrate insulating material 60 located within a portion of a channel 50. The remaining figures are shown free of insulating material so that further details of the channel 50 can be illustrated.

FIG. 2 illustrates a front right perspective of the embodiment illustrated in FIG. 1. Insulating material 60 is shown filling channel 50 to a depth below the lower edge of cutout 30. The insulating material 60 is contained within the sealing system 20 by the switch box 10 and seal plates 22. Due to the conformity of the groove 24 of seal plates 22 to the outer contour of the rail, which in this embodiment includes rail jacket 48, insulating material 60 is contained within channel 50.

FIG. 3 is a forward-looking right side perspective view of a further embodiment of the sealing system 20 particularly illustrating connection of the sealing plate 22 to an inside wall of side 12 of switch box 10. In this embodiment, fasteners 70 connect the seal plate 22 to the switch box 10. Seal plate 22 is in direct contact with rail 40 in this embodiment as the rail jacket 48 has an end located in channel 50.

FIG. 4 illustrates an additional configuration of seal plate 22 that conforms to the outer surface of the rail jacket 48. This embodiment shows the versatility of seal plates 22 that can be formed to have a groove of substantially any shape. Insulating material 60 is illustrated in channel 50 having a height that extends substantially to the base of cutout 30.

Figure 5:
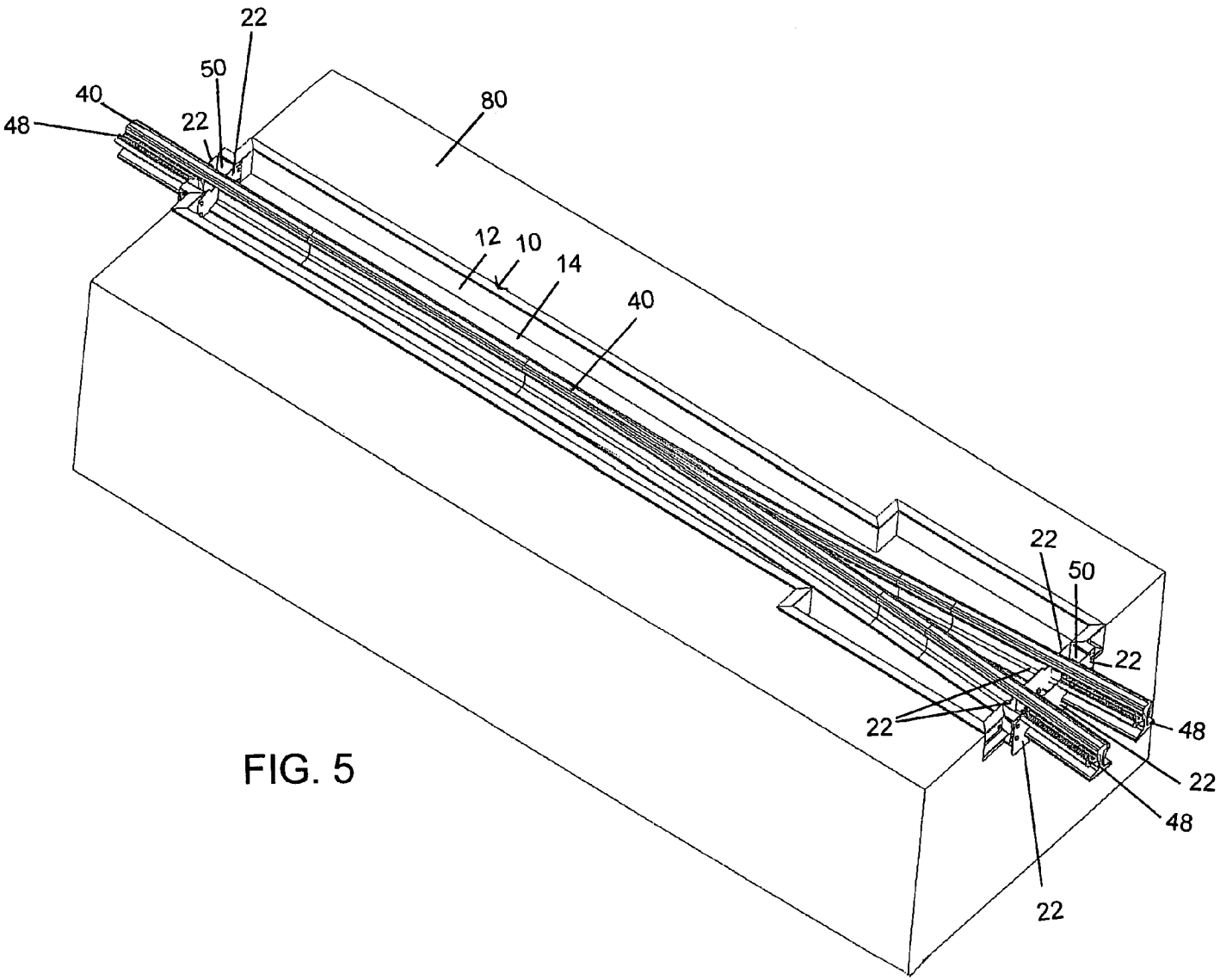
FIG. 5 is a front right perspective view showing a further embodiment of the sealing system in the present invention installed in a switch or rail box, wherein one under the rail box includes two rail sections extending outwardly through the sealing plate.

FIG. 5 illustrates a front right perspective view of a switch box 10 including a sealing system 20 in the present invention. The right side of the figure illustrates seal plates 22 having a pair rails 40 extending therethrough. One end of the rail jacket 48 terminates within channel 50 of the sealing system 20.

Figure 6:
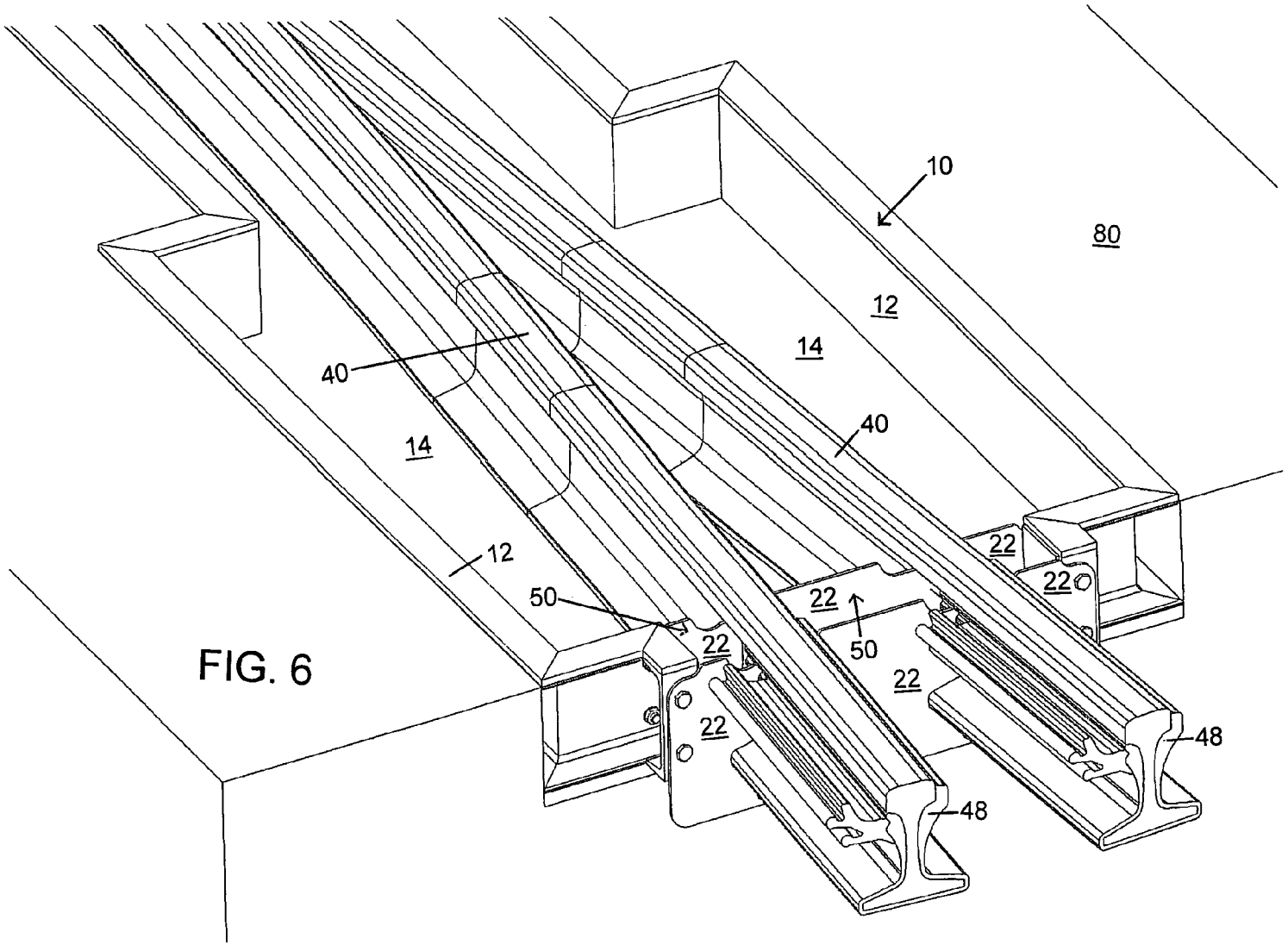
FIG. 6 is a right front perspective view of a portion of the embodiment illustrated in FIG. 5.
Figure 7:
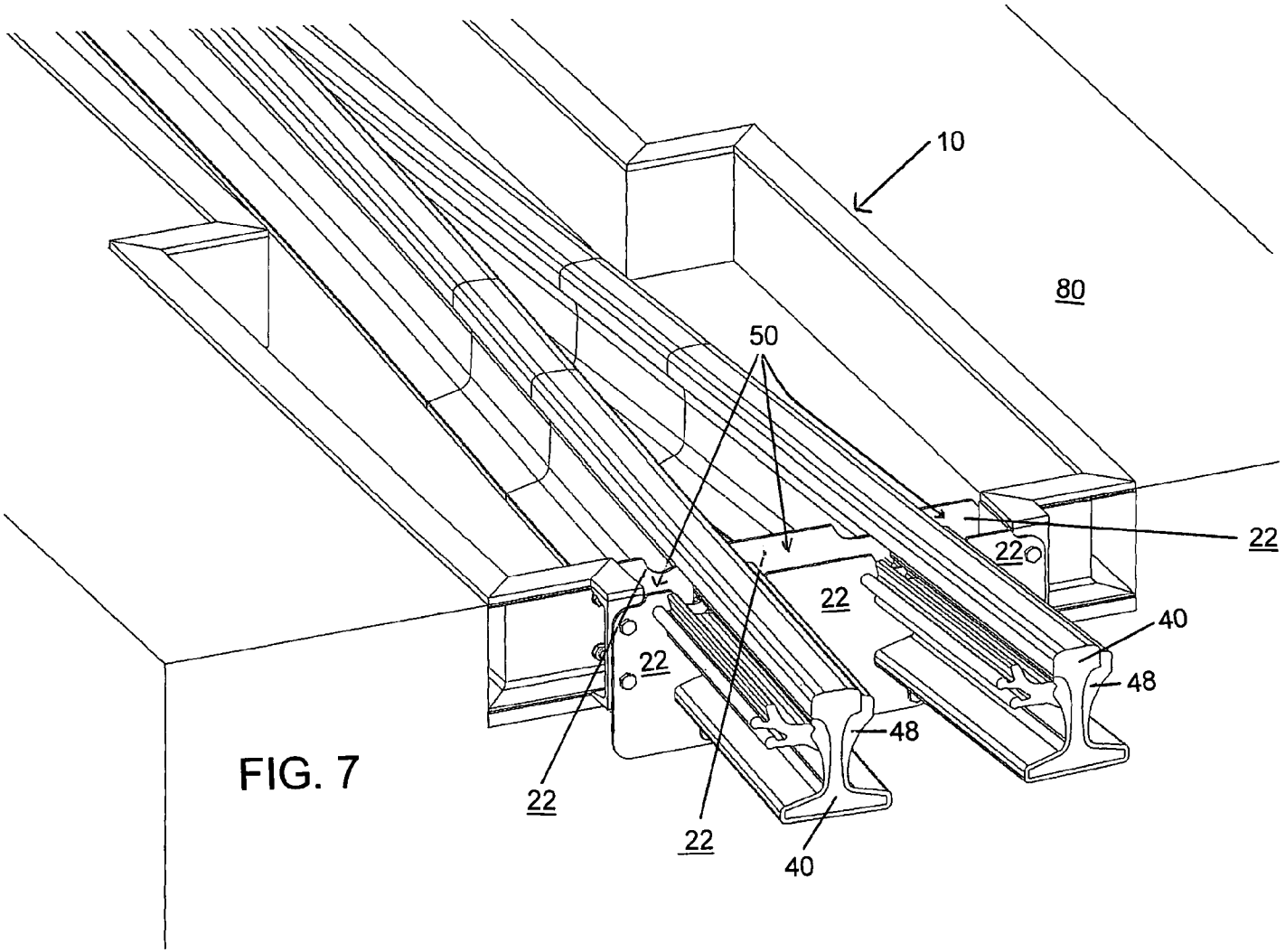
FIG. 7 is a front right perspective view showing a further embodiment of the sealing system in the present invention installed in a switch or rail box, wherein the rail box includes two rail sections extending outwardly through the sealing plates.

FIGS. 6 and 7 are close-up views of the embodiment illustrated in FIG. 5.

The invention can be used in new systems as well as for retrofitting existing systems. It is versatile enough to seal around any type of rail insulation—TPE or rubber boot, rubber lining, polyurethane coating, etc.

In accordance with the patent statutes, the best mode and preferred embodiment have been set forth; the scope of the invention is not limited thereto, but rather by the scope of the attached claims.

What is claimed is:

1. A rail or switch box system for railway rails, comprising:

a rail box having a side wall including an aperture adapted to have a portion of a rail extend therethrough;

a first seal plate connected to an inner surface of the rail box side wall about a portion of the aperture;

a second seal plate connected to an outer surface of the rail box side wall about a portion of the aperture;

one or more rails having a portion extending through a groove in the first and second plates and the aperture in the box; and an insulating material located between the first plate and second plate and in contact with a portion of the rail.

2. The rail or switch box system for railway rails according to claim 1, wherein a channel is formed between the first seal plate, the second seal plate, the side of the rail box, and a bottom of the rail box, and wherein the insulating material is located in the channel and in contact with the first plate and the second plate.

3. The rail or switch box system for railway rails according to claim 2, wherein the first and second seal plates each have a cutout in an upper end of the seal plate adapted to allow a wheel flange of a vehicle traveling on the rail to pass the seal plate without contacting the same.

4. The rail or switch box system for railway rails according to claim 3, wherein the first seal plate and second seal plate each are formed from one or more individual plates, with the plates connected to the rail box utilizing a fastener.

5. The rail or switch box system for railway rails according to claim 4, wherein the rail includes a rail jacket, wherein the rail jacket is formed from an insulating material, and wherein the rail jacket has an end that terminates within the channel, and wherein the rail jacket in the channel is in contact with the insulating material.

6. The rail or switch box system for railway rails according to claim 5, wherein the insulating material fills the channel to a height that terminates at or below a lower edge of the cutout, and wherein each of the seal plates includes a nonconductive surface.

7. A method for sealing a portion of a rail box, comprising the steps of:

obtaining a box having at least two apertures in a side wall of the box;

orienting at least one rail such that the rail extends through one of the apertures in the side wall of the box;

attaching a first seal plate to an outer surface of the side wall of the box and a second seal plate to an inner surface of the side wall of the box around the rail, the seal plates thereby covering a portion of an aperture in the side wall of the box and forming a channel between the seal plates; and adding an insulating material to the channel formed between the first plate and second plate, with the insulating material contacting each plate and a portion of one or more rails.

8. The method according to claim 7, wherein each seal plate includes a cutout located between an upper end of the seal plate and a groove that substantially conforms to a portion of a shape of the rail, and wherein the insulating material is added to the channel to a height at or below a lower end of the cutout of the seal plate.

9. The method according to claim 8, wherein an insulating material is added so that it additionally contacts a bottom and the side wall of the box.

10. The method according to claim 7, further including the step of forming the first seal plate with a groove that substantially conforms to a shape of a portion of the rail.

11. The method according to claim 10, wherein attaching the first seal plate includes assembling two or more plate sections.

12. The method according to claim 7, wherein the first seal plate and second seal plate are attached to the box utilizing fasteners.

13. The method according to claim 7, wherein the first seal plate and the second seal plate are formed having a nonconductive surface.

* * * * *

UNITED STATES PATENT AND TRADEMARK OFFICE

CERTIFICATE OF CORRECTION

PATENT NO. : 8,336,831 B2
APPLICATION NO. : 12/925061
DATED : December 25, 2012
INVENTOR(S) : Naquin It is certified that error appears in the above-identified patent and that said Letters Patent is hereby corrected as shown below:

On the title page, under the heading "Inventor:"

"Rene' Naquin" should be --René Naquin--.

Signed and Sealed this
Nineteenth Day of March, 2013

Teresa Stanek Rea
*Acting Director of the United States Patent and Trademark Office*